US006736526B2

(12) United States Patent
Matsuba et al.

(10) Patent No.: US 6,736,526 B2
(45) Date of Patent: May 18, 2004

(54) BULB-TYPE LAMP AND MANUFACTURING METHOD FOR THE BULB-TYPE LAMP

(75) Inventors: Tetsuo Matsuba, Neyagawa (JP); Yoshinori Kakuno, Katano (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/100,707

(22) Filed: Mar. 19, 2002

(65) Prior Publication Data

US 2002/0141190 A1 Oct. 3, 2002

(30) Foreign Application Priority Data

Mar. 27, 2001 (JP) ..... 2001-089489

(51) Int. Cl.[7] ..... F21K 27/00

(52) U.S. Cl. ..... 362/260; 362/373; 362/294; 313/318.02; 313/634; 315/56

(58) Field of Search ..... 362/294, 373, 362/260, 26, 261, 186; 313/493, 634, 318.02; 315/56, 58

(56) References Cited

U.S. PATENT DOCUMENTS 5,504,666 A * 4/1996 Carmichael ..... 362/294
5,545,950 A * 8/1996 Cho ..... 315/56
5,828,170 A * 10/1998 Nishio et al. ..... 313/493
5,844,357 A * 12/1998 Iida et al. ..... 313/493
6,153,972 A * 11/2000 Katougi et al. ..... 313/493
6,172,452 B1 * 1/2001 Itaya et al. ..... 313/490
6,492,773 B2 * 12/2002 Gyoten et al. ..... 315/56

FOREIGN PATENT DOCUMENTS

| | | |
|---|---|---|
| EP | 704101 | 9/1999 |
| JP | 6196000 | 7/1994 |
| JP | 8511650 | 12/1996 |

* cited by examiner

*Primary Examiner*—John Anthony Ward

(57) ABSTRACT

To provide a bulb-type lamp in which a globe is fixed to a case without a tilt, and a manufacturing method for the bulb-type lamp. The globe is bonded to a connector using a thermosetting resin, in a state where a neck part of the globe is inserted in a groove of the connector without contacting the bottom of the groove. The connector is then fixed to the case by means of a fitting construction. This makes it unnecessary to perform a heating process to cure an adhesive after an envelope is formed by the globe and the case. Hence the tilting of the globe caused by the thermal expansion of air in the envelope can be prevented.

17 Claims, 10 Drawing Sheets

11

BULB-TYPE LAMP AND MANUFACTURING METHOD FOR THE BULB-TYPE LAMP

This application is based on an application Ser. No. 2001-089489 filed in Japan, the content of which is hereby incorporated by reference.

BACKGROUND OF THE INVENTION

1. Field of the Invention

The present invention relates to a bulb-type lamp having a globe, such as a bulb-type fluorescent lamp and an electrodeless discharge lamp, and a manufacturing method for the bulb-type lamp.

2. Related Art

A bulb-type lamp is a kind of lamp in which a spherical globe, like the one used in an incandescent lamp, is fixed to a case. Examples of such a bulb-type lamp include bulb-type fluorescent lamps and electrodeless discharge lamps. The globe is usually made of glass in consideration of the heat generated in the lamp. Also, the globe is fixed to the case using an adhesive made of a thermosetting resin, such as a silicon resin, which has excellent heat resistance and sealing ability.

The following explains a construction of a bulb-type lamp and a method of fixing a globe to a case, taking a bulb-type fluorescent lamp as an example.

FIG. 10 is a partial broken front view of a conventional bulb-type fluorescent lamp.

This bulb-type fluorescent lamp has a globe 900, a case 910, an arc tube 920, and a holder 930. The globe 900 is made of glass and has one end opened. The case 910 is made of a resin and is engaged with the open end of the globe 900. The arc tube 920 is made up of three U-shaped fluorescent tubes which are bridge-connected. The holder 930 is made of a resin, and is housed in an envelope formed by the globe 900 and case 910. The holder 930 holds the arc tube 920 on one surface and an electric ballast 931 for illuminating the arc tube 920 on the other surface, and is fixed into an opening of the case 910.

Here, a groove 940 is formed between the case 910 and the holder 930, along the periphery of the case 910. An edge part 900*a* of the globe 900 is inserted in this groove 940 and bonded to the case 910 through a thermosetting adhesive 941.

Such a bulb-type fluorescent lamp can be manufactured as follows. First, the arc tube 920 and the electric ballast 931 are attached to the holder 930. The holder 930 is then inserted into the case 910 with the electric ballast 931 being inserted first. Hence the electric ballast 931 is housed in the case 910. Following this, the thermosetting adhesive 941 is injected into the groove 940 formed between the case 910 and the holder 930, and the edge part 900*a* of the globe 900 is inserted into the groove 940. The construction is then placed in a heating furnace and heated therein, to cure the thermosetting adhesive 941. As a result, the globe 900 is fixed to the case 910 through the adhesive 941.

With this manufacturing method, however, the globe 900 may be fixed to the case 910 in a tilted position. This causes a failure of holding the globe 900 in a correct position.

Prior to the heating process in the heating furnace, the globe 900 and the case 910 are substantially in tight contact with each other through the adhesive 941 and so the envelope formed by the globe 900 and case 910 is hermetically sealed. When the bulb-type fluorescent lamp in this state is heated in the heating furnace, the air in the envelope expands and the internal pressure increases. This being so, if the adhesive 941 is not hardened yet but is still soft, the internal pressure of the envelope may cause the globe 900 to be pushed up or tilted. If the adhesive 941 hardens in such a state, the globe 900 will end up being fixed to the case 910 in a tilted position (in more detail, the edge part 900*a* of the globe 900 is tilted upward on one side by about 4 mm). As a result, the globe 900 cannot be held in a correct position.

Bulb-type fluorescent lamps with tilted globes are all abandoned without being reused, because of their defective external appearances. Since these products are almost in finished form, they are costly and so abandoning them inevitably increases manufacturing costs.

To avoid the tilting of the globe, the following method may be employed instead of using a thermosetting resin as above. Which is to say, a stopper is provided to the edge part of the globe, whereas a stopper holding part is provided to the case. By engaging the stopper with the stopper holding part, the globe can be secured to the case. However, because the globe is made of glass, the stopper of the globe is not only difficult to form but also likely to break when engaged with the stopper holding part. For this reason, this type of bulb-type fluorescent lamp is not very practical.

The same problem can be found in electrodeless discharge lamps that have a construction similar to bulb-type fluorescent lamps, namely, a construction in which a globe is fixed to a case.

SUMMARY OF THE INVENTION

The present invention has an object of providing a bulb-type lamp that holds a globe in a correct position and so delivers an improved external appearance, and a manufacturing method for the bulb-type lamp.

The stated object can be achieved by a bulb-type lamp including: a globe having a constricted neck part at one end; a connector having a ring-shaped groove in which the neck part of the globe can be inserted, wherein the globe is bonded to the connector in a state where the neck part is inserted in the groove; a holder having a stand that supports an electric ballast; and a case having an opening, and holding the holder in a state where the holder is inserted in the case through the opening with the electric ballast being inserted first, wherein in the opening of the case, the connector to which the globe is bonded is fixed to one of the case and the holder by a fitting construction.

With this construction, the globe is held in place just by engaging the connector, to which the globe is bonded, with the case or the holder. This eliminates the need for the heating process which is conventionally performed after the envelope is formed by the globe and case. Accordingly, the tilting of the globe caused by the expansion of air in the envelope is prevented, with it being possible to hold the globe without a tilt relative to the case. As a result, the external appearance of the bulb-type lamp improves. This reduces the number of defective products, so that increases of manufacturing costs caused by abandoning defective products can be suppressed.

Here, the globe may be bonded to the connector in a state where the neck part which is inserted in the groove is kept from contact with a bottom of the groove.

With this construction, the tilting of the globe can be prevented more efficiently.

Here, the fitting construction may include a depression and a projection that fit together, the depression and the projection each being provided at a different one out of (a) the connector and (b) one of the case and the holder.

Here, the bulb-type lamp may be a bulb-type fluorescent lamp in which a fluorescent tube is supported by the stand of the holder, wherein the globe is a hollow spherical member having an open end at which the neck part is formed, a light diffusion film is formed on an internal surface of the globe using an adhesive, and the adhesive used for forming the light diffusion film is also used for bonding the globe to the connector.

With this construction, it becomes unnecessary to prepare another adhesive to bond the globe to the connector, since a single adhesive serves to form the light diffusion film and also to bond the globe to the connector. This contributes to lower manufacturing costs.

Here, the connector may be a ring having an inner wall and an outer wall which together form a U-shaped cross section, with the ring-shaped groove being present between the inner wall and the outer wall, and the globe is bonded to the connector using part of the adhesive which is gathered in the groove.

With this construction, an excess of low-viscosity adhesive which is used to form the light diffusion film can be gathered in the groove and put to use for bonding the globe to the connector.

Here, an arch-shaped leaf spring may be formed by cutting part of the inner wall of the connector, wherein the leaf spring presses the neck part which is inserted in the groove, to temporarily tack the connector to the globe until the adhesive gathered in the groove hardens.

With this construction, the globe and the connector can be positioned easily at the time of bonding, with it being possible to avoid displacements.

Here, the inner wall of the connector may have a smaller height than the outer wall of the connector.

With this construction, an excessive amount of adhesive in the groove overflows not from the outer wall but from the inner wall, so that the external appearance of the bulb-type lamp will not be ruined.

Here, a depression and a projection that fit together may be each provided at a facing portion of a different one of the connector and the holder, so that the connector and the holder move in conjunction with a rotation of the globe which is bonded to the connector.

With this construction, when the user installs the bulb-type lamp into a socket, the globe will be kept from becoming unattached from the case and turning freely on its own.

Here, the bulb-type lamp may be an electrodeless discharge lamp in which a core supporter is supported by the stand of the holder, and a coil form on which an induction coil is wound is supported by the core supporter.

The stated object can also be achieved by a manufacturing method for a bulb-type lamp, including: a holding step for holding a holder which has a stand supporting an electric ballast, by a case which has an opening, in a state where the holder is inserted in the case through the opening with the electric ballast being inserted first; a bonding step for bonding a globe which has a constricted neck part at one end, to a connector which has a ring-shaped groove in which the neck part of the groove can be inserted, in a state where the neck part is inserted in the groove; and a fixing step for fixing the connector to which the globe is bonded, to one of the case and the holder by a fitting construction, in the opening of the case.

With this method, the globe is held in place just by engaging the connector, to which the globe is bonded, with the case or the holder. This eliminates the need for the heating process which is conventionally performed after the envelope is formed by the globe and case. Accordingly, the tilting of the globe caused by the expansion of air in the envelope is prevented, with it being possible to hold the globe without a tilt relative to the case. As a result, the external appearance of the bulb-type lamp improves. This reduces the number of defective products, so that increases of manufacturing costs caused by abandoning defective products can be suppressed.

Here, in the bonding step a fixed distance may be maintained between a furthermost end of the connector and a furthermost end of the globe, wherein an adhesive is injected into the groove while keeping the neck part which is inserted in the groove from contact with a bottom of the groove, to bond the globe to the connector.

The globe is usually formed from glass and therefore tends to have variations in size. However, if the globe is bonded to the connector by injecting the adhesive into the groove while maintaining a fixed distance between the furthermost ends of the connector and globe and also keeping the neck part of the globe from contact with the bottom of the groove, the globe and the connector are held together without a tilt. As a result, a bulb-type lamp with a uniform height can be produced.

Here, the bulb-type lamp may be a bulb-type fluorescent lamp in which (a) the globe is a hollow spherical member having an open end at which the neck part is formed, and (b) a light diffusion film is formed on an internal surface of the globe using an adhesive in which a light diffusion material is dispersed, wherein when the adhesive is applied to the internal surface of the globe to form the light diffusion film, an excess of the adhesive drops and is gathered in the groove of the connector, the gathered adhesive being used to bond the globe to the connector in the bonding step.

With this construction, the adhesive used for forming the light diffusion film is also used for bonding the globe to the connector. This contributes to lower manufacturing costs.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

First Embodiment

The first embodiment that applies the present invention to a bulb-type fluorescent lamp is described below, by referring to drawings.

(Construction of a Bulb-type Fluorescent Lamp)

Figure 1:
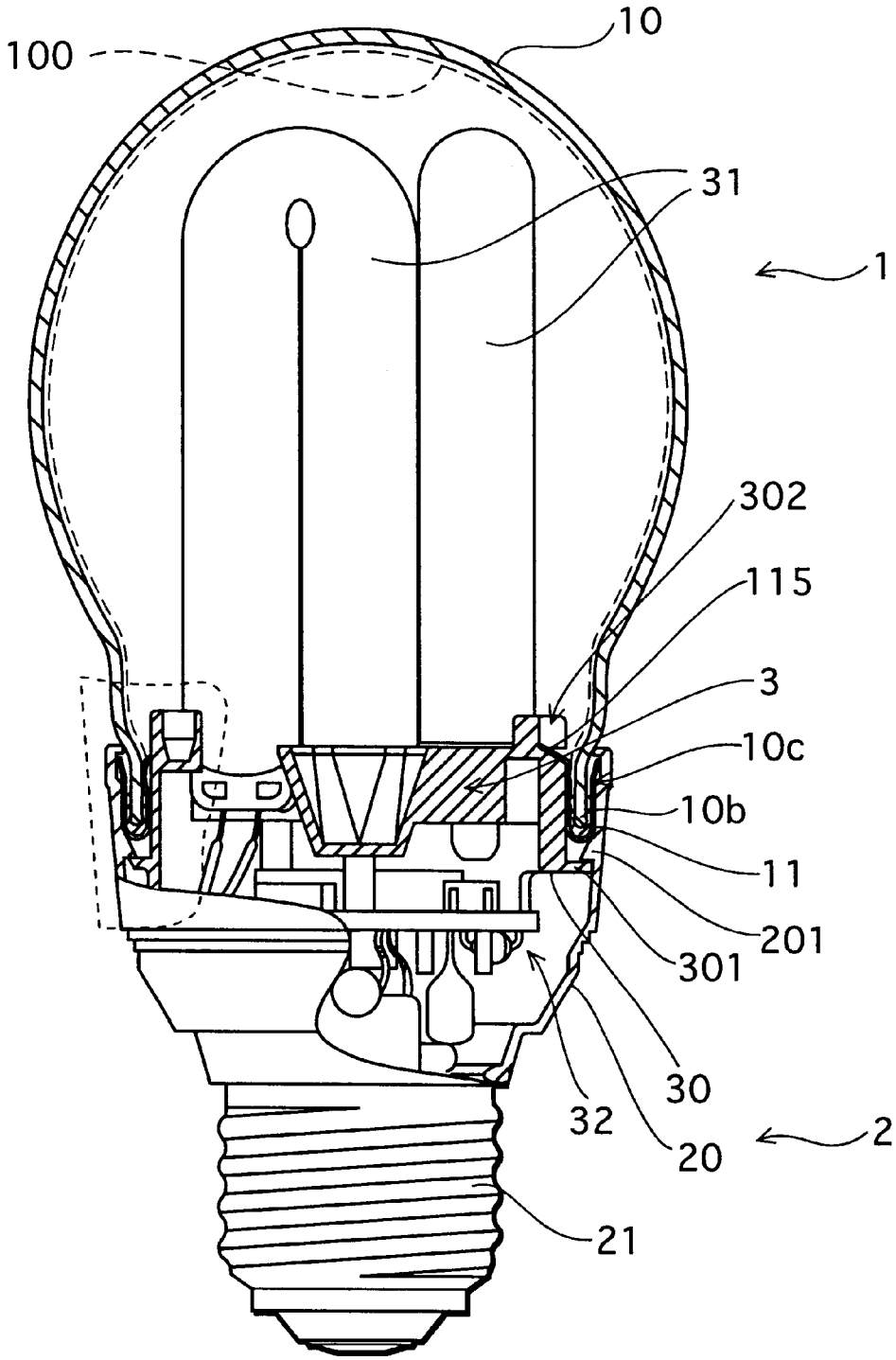
FIG. 1 is a partial broken front view of a bulb-type fluorescent lamp to which the first embodiment of the invention relates.
Figure 2:
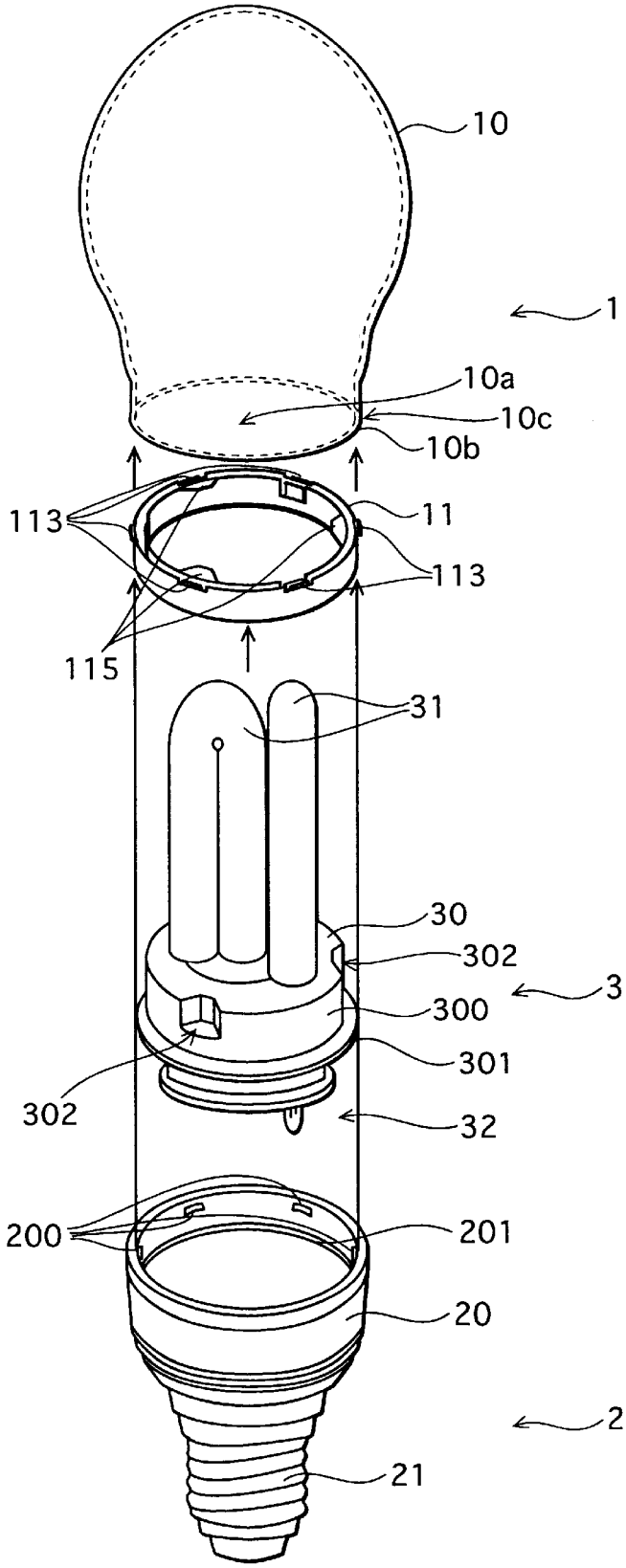
FIG. 2 is a developed view of the bulb-type fluorescent lamp.

FIG. 1 is a partial broken front view of a bulb-type fluorescent lamp of the first embodiment. FIG. 2 is a developed view of the bulb-type fluorescent lamp.

This bulb-type fluorescent lamp has a power rating of 13 W. As shown in FIG. 2, the bulb-type fluorescent lamp has a globe unit 1, a case unit 2, and an arc tube unit 3. The arc tube unit 3 holds a fluorescent tube 31, and is housed in an envelope formed by the globe unit 1 and case unit 2.

The globe unit 1 includes a globe 10, and a connector 11 which is bonded to an edge part 10*b* at an open end of the globe 10 using an adhesive.

The globe 10 is made of pear-shaped glass having an opening 10*a*. A narrow constricted neck part 10*c* is formed near the opening 10*a*. The internal surface of the globe 10 is coated with a light diffusion film 100 (FIG. 1) that diffuses light emitted from the fluorescent tube 31. The light diffusion film 100 can be formed by dispersing a light diffusion powder in a thermosetting adhesive, and applying the result to the internal surface of the globe 10 and heat-hardening it. Here, the light diffusion powder may be made of calcium carbonate, magnesium oxide, silica, titanium oxide, a phosphor, or the like, whereas the thermosetting adhesive may be made of a water-soluble acrylic emulsion, or organic nitrocellulose or ethyl cellulose. Also, to prevent damage caused by cracking, the edge part 10*b* at the opening 10*a* of the globe 10 has been heated with a burner. As a result of this, the edge part 10*b* attains a round cross section (see FIG. 3) and also attains some variations in height along the periphery of the globe 10. It should be noted here that the material for the globe 10 is not limited to glass, as the globe 10 may also be formed from other materials with excellent heat resistance, such as ceramic.

The connector 11 is a ring having a U-shaped cross section, and is formed by stamping an iron plate. The connector 11 is bonded to the edge part 10*b* of the globe 10 using an adhesive. Here, it is preferable to use a thermosetting adhesive with high heat resistance, but a non-thermosetting adhesive, such as an adhesive that hardens by absorbing water in the atmosphere, is applicable too. The connector 11 is engaged with a case 20 in the case unit 2, as a result of which the globe unit 1 is fixed to the case unit 2.

The case unit 2 is used to fix the globe unit 1, and also house the arc tube unit 3. The case unit 2 has the case 20 and a base 21.

The case 20 is formed from a resin having high heat resistance, such as polybutylene terephthalate (PBT). The case 20 is a tapered cylinder with one end opened and the other end sealed with the base 21. Here, the base 21 is an E-type base. The internal surface of the case 20 has six depressions 200 at regular intervals along the periphery, in which stoppers 113 of the connector 11 are to be caught (though only four of the depressions 200 are shown in FIG. 2). The internal surface of the case 20 also has a projection 201 along the periphery, below the depressions 200. The projection 201 is used to engage with a collar 301 of a holder 30 in the arc tube unit 3. By engaging the collar 301 with the projection 201, the arc tube unit 3 is attached securely to the case unit 2.

The arc tube unit 3 has the holder 30, the fluorescent tube 31, and an electric ballast 32. The fluorescent tube 31 is made up of three U-shaped fluorescent tube bulbs (though only two of them are shown in FIGS. 1 and 2) which are bridge-connected. The electric ballast 32 has a construction in which circuits, such as a transistor and a capacitor, for illuminating the fluorescent tube 31 are provided on a substrate. The fluorescent tube 31 is provided on one surface of the holder 30, whereas the electric ballast 32 is provided on the other surface of the holder 30. Note that though the transistor, the capacitor, and the like are attached to the holder 30 in this example, they may be provided outside the bulb-type fluorescent lamp as a separate unit. In such a case, wiring for supplying power to the fluorescent tube 31 serves as the electric ballast 32.

The holder 30 includes a cylindrical stand 300 and the collar 301 which is provided at the lower end of the cylindrical stand 300 along the periphery. The fluorescent tube 31 is mounted on top of the stand 300, while the electric ballast 32 is mounted at the bottom of the stand 300. The holder 30 is inserted into the case 20 with the electric ballast 32 entering first, as a result of which the collar 301 engages with the projection 201 in the case 20 and so the arc tube unit 3 is secured to the case unit 2.

Also, three depressions 302 are provided on the upper end of the stand 300 at regular intervals (though one of them is hidden behind the U-shaped fluorescent tube bulbs in FIG. 2). These depressions 302 and rotation prohibiting parts 115 (FIG. 4) of the connector 11 fit together. With this fitting, even if the user holds and rotates the globe 10 while screwing the bulb-type fluorescent lamp into a socket, the holder 30 and the connector 11 are kept from sliding in the direction of rotation. Therefore, the rotational power applied by the user is transmitted to the base 21, with it being possible to reliably install the bulb-type fluorescent lamp into the socket.

The fluorescent tube 31 is made up of the three U-shaped glass bulbs which are bridge-connected, as noted above. Each glass bulb has electrodes at both ends (not illustrated). A predetermined amount of mercury and a predetermined amount of noble gas are enclosed in each glass bulb which is coated with a phosphor film on its internal surface. Hence a crooked discharge path is formed inside the fluorescent tube 31.

(Construction of the Connector 11)

A construction of the connector 11 which is a characteristic component in this embodiment is described below.

Figure 3:
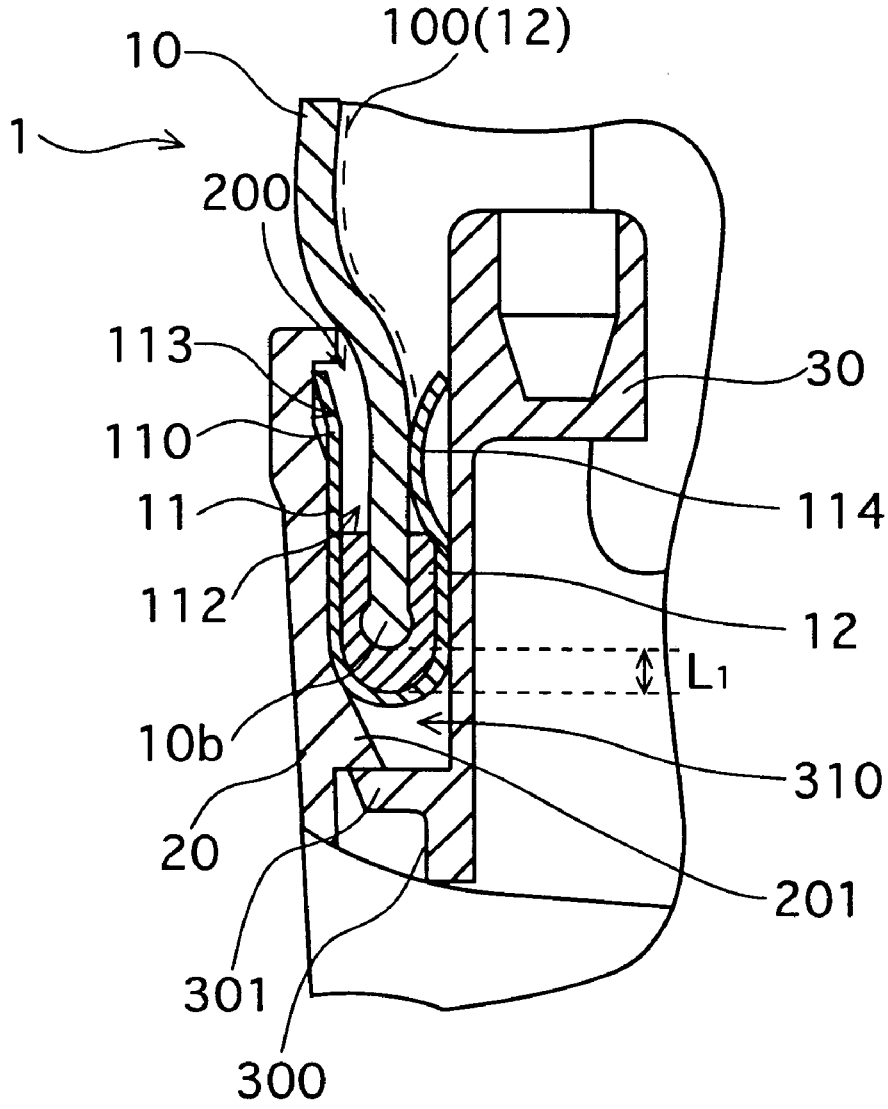
FIG. 3 is an expanded sectional view of main part of the bulb-type fluorescent lamp.

FIG. 3 is an expanded sectional view of a part of the bulb-type fluorescent lamp shown in FIG. 1 which is enclosed by a dashed line.

As illustrated, the holder 30 is fixed to the case 20 by fitting the collar 301 of the holder 30 and the projection 201 of the case 20 together. The connector 11 is inserted in a groove 310 formed between the case 20 and the holder 30 along the periphery.

Figure 4:
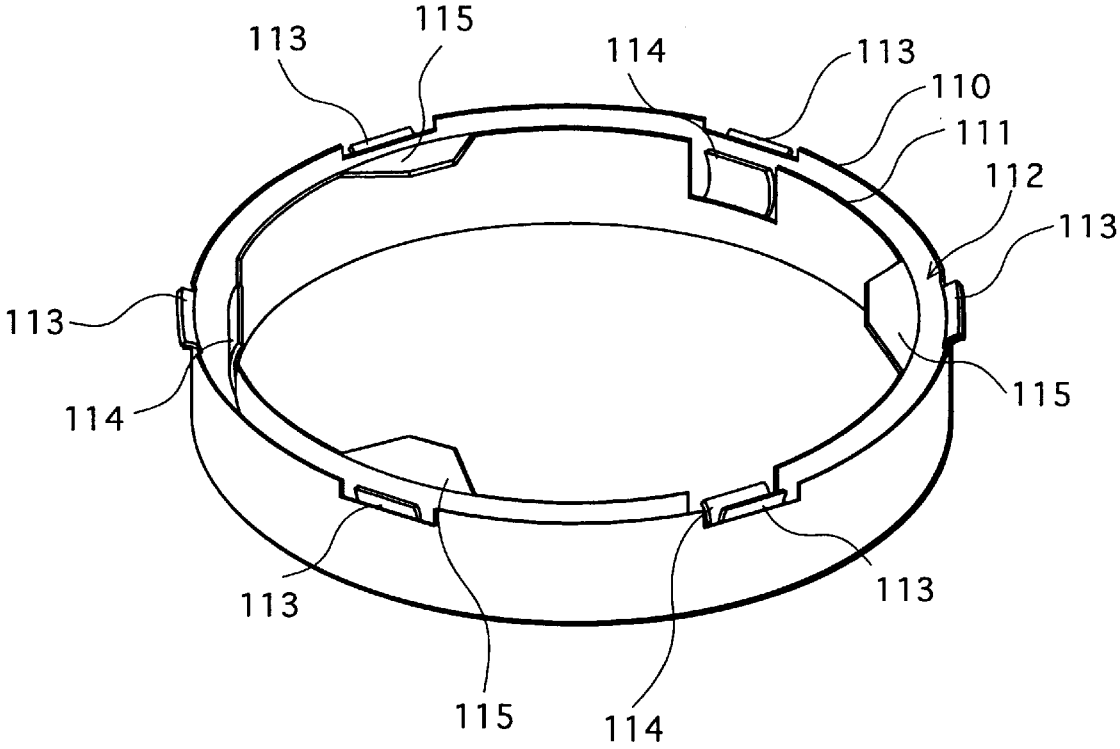
FIG. 4 is a perspective view of a connector.

FIG. 4 is a perspective view of the connector 11.

As shown in the drawing, the connector 11 is a ring with a U-shaped cross section (FIG. 3) that has an outer wall 110 and an inner wall 111 which are connected at the bottom. For example, the size of the connector 11 is such that the outer diameter of the outer wall 110 is 44 mm (excluding the stoppers 113), the inner diameter of the inner wall 111 is 37 mm (excluding holding parts 114 and the rotation prohibiting parts 115), and the height of the outer wall 110 is 10 mm.

A groove 112 exists between the outer wall 110 and the inner wall 111 along the periphery. For example, the groove 112 has a width of 2 to 4.5 mm, and a depth of 8–9 mm with respect to the outer wall 110. The connector 11 may be formed from a metal such as phosphor bronze, iron, aluminum, nickel, copper, brass, or stainless steel. As an alternative, the connector 11 may be formed from a resin such as PBT, polycarbonate (PC), polyethylene terephthalate (PET), or acrylic.

The outer wall 110 of the connector 11 is cut, on the open end side, at six portions to form the six stoppers 113 which project from the outer wall 110. The stoppers 113 are provided with a 60° pitch along the periphery. By fitting the stoppers 113 into the depressions 200 of the case 20 as shown in FIG. 3, the connector 11 is fixed to the case 20 without using an adhesive. In other words, the globe unit 1 is fixed to the case unit 2 by means of fitting, so that there is no need to perform the heating to cure an adhesive after the formation of the envelope. Since the heating process which is conventionally performed after the formation of the envelope is unnecessary, the tilting of the globe caused by the expansion of air in the envelope can be prevented.

Also, the inner wall 111 of the connector 11 is cut, on the open end side, at three portions with regular intervals, to form the three holding parts 114 which project from the inner wall 111, as shown in FIG. 4. As shown in FIG. 3, these holding parts 114 are curved in an arch form toward the groove 112. When bonding the globe 10 to the connector 11 using an adhesive in the manufacturing of the bulb-type fluorescent lamp, the holding parts 114 press the vicinity of the edge part 10*b* of the globe 10 so as to temporarily tack the connector 11 at an installation position until the adhesive hardens. In this way, displacements are suppressed.

The connector 11 has a U-shaped cross section. An adhesive 12 is injected into the groove 112 and stays there. Which is to say, even if the adhesive 12 has low viscosity, it remains in the groove 112, so that a sufficient amount of adhesive can be secured to bond the globe 10 and the connector 11 to each other. By inserting the edge part 10*b* of the globe 10 into the groove 112 and then injecting the adhesive 12 into the groove 112 which allows the adhesive 12 to stay there, the globe 10 is bonded to the connector 11 at the edge part 10*b*.

Here, it is preferable to position the edge part 10*b* of the globe 10 at a distance L1 from the bottom of the groove 112, as shown in FIG. 3. The reason for this is given below. The edge part 10*b* of the globe 10 has been heated with a burner to prevent damage due to cracking. This being so, though cracks are fusion-bonded to each other, the edge part 10*b* becomes varied in height along the periphery, that is, the edge part 10*b* attains surface irregularities. In such a case, if the edge part 10*b* is in contact with the bottom of the groove 112, such surface irregularities are likely to cause the globe 10 to tilt. However, if the edge part 10*b* is positioned at the distance L1 from the bottom of the groove 112, the adhesive 12 acts as a spacer to attach the globe 10 to the connector 11 without a tilt. For the same reason, even if the height of the globe 10 has some variations, the globe unit 1 can be formed with a uniform height.

Thus, the bulb-type fluorescent lamp of this embodiment is manufactured by bonding the globe 10 to the connector 11 using the adhesive 12 and then fixing the connector 11 to which the globe 10 is bonded, to the case 20 by means of fitting. Accordingly, the globe 10 can be fixed to the case 20 without having to perform the conventional heating process after the formation of the envelope. Hence the tilting of the globe 10 is prevented. Also, since the globe 10 and the connector 11 are bonded to each other with a gap in between, the globe unit 1 can be formed in a desired shape regardless of the shape of the globe 10. When such a globe unit 1 is fixed to the case unit 2, the globe 10 is held in a correct position without tilting against the case 20. This enables a bulb-type fluorescent lamp having a uniform height to be produced.

(Manufacturing Method for the Bulb-type Fluorescent Lamp)

The following is an explanation of a method of manufacturing the above bulb-type fluorescent lamp.

A process of bonding the edge part 10*b* of the globe 10 to the connector 11 is explained first.

FIG. 5 shows the manufacturing process of bonding the edge part 10*b* to the connector 11. The process proceeds in the order of FIGS. 5A to 5D.

Figure 5A:
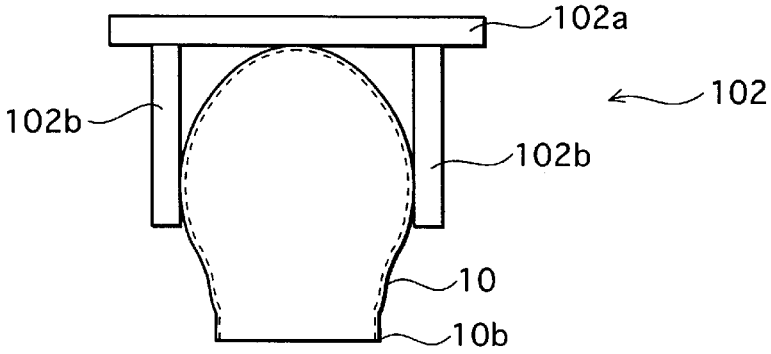
FIGS. 5A–5D are each a front view of the globe, in a manufacturing process of bonding the globe to the connector.

In FIG. 5A, the globe 10 is held by a holder 102. The holder 102 has a support 102*a* and two arms 102*b* which are each held by the support 102*a* so as to be slidable in its facing direction. Also, each arm 102*b* is given elasticity in its facing direction. The holder 102 holds the globe 10 with the two arms 102*b*, in such a manner that the top of the globe 10 is in contact with the support 102*a* and the edge part 10*b* of the globe 10 is positioned underneath it. Here, to hold the globe 10 securely, it is more preferable for the holder 102 to have at least three arms.

Figure 5B:
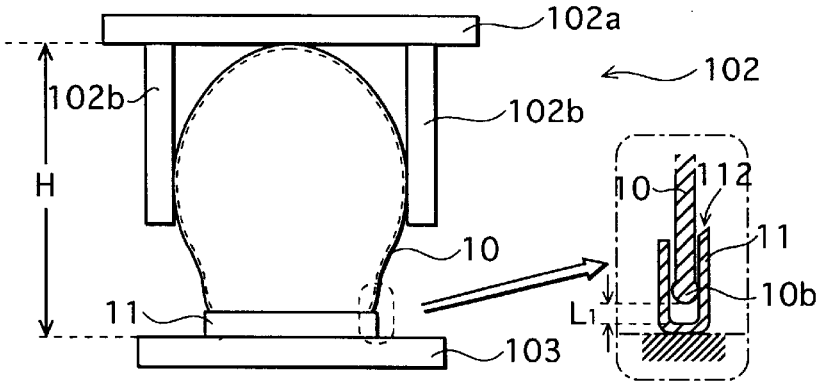

In FIG. 5B, the connector 11 is placed on a mounting stand 103 which is used for positioning the connector 11. The mounting stand 103 is then lifted up so that the edge part 10*b* is inserted into the groove 112 of the connector 11. Here, the mounting stand 103 is equipped, on its mounting surface, with positioning means which engages with the connector 11, to ensure that the connector 11 is mounted at a predetermined position. The positioning means can be realized by forming, on the mounting surface, a ring-shaped depression that engages with the connector 11 or a cylindrical projection that engages with the center hole of the connector 11. Also, the height to which the mounting stand 103 is lifted is set such that the distance between the support 102*a* and the lifted mounting stand 103, i.e., the distance between the upper end of the globe 10 and the lower end of the connector 11, is a predetermined distance H. Though the distance H can be determined depending on the size of the globe 10, it is preferable to set such a distance H that allows the gap L1 to be present between the edge part 10*b* and the bottom of the groove 112. Usually, each globe 10 is formed by putting glass in a shaping die. This being the case, when the size of the shaping die changes with use, the height of each globe 10 may vary to some degree. However, by setting such a fixed distance H that keeps the edge part 10*b* from contact with the bottom of the groove 112, the distance between the upper end of the globe 10 and the lower end of the connector 11 is made uniform. As a result, the globe unit 1 can be formed with a uniform height.

Figure 5C:
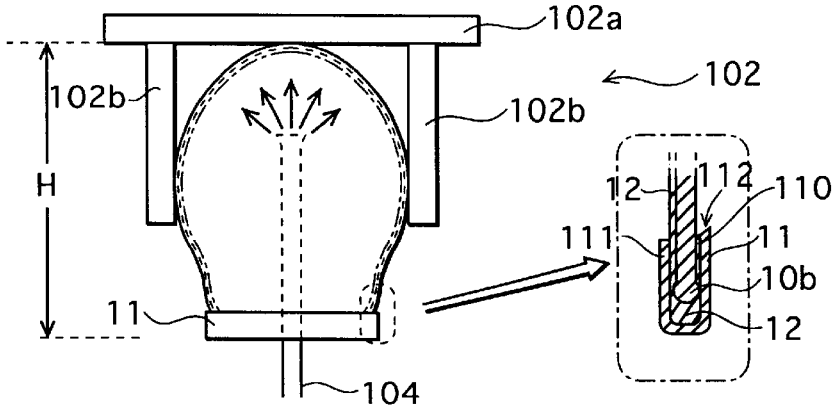

In the state where the edge part 10*b* of the globe 10 is inserted in the groove 112 of the connector 11, the connector 11 is temporarily tacked to the vicinity of the edge part 10*b* by the pressure from the holding parts 114 (FIGS. 3 and 4). Accordingly, the mounting stand 103 can be detached from the connector 11, as shown in FIG. 5C. Following this, a spray nozzle 104 is inserted into the globe 10 through the hole of the connector 11, and the adhesive 12 which contains a light diffusion material is discharged from the tip of the nozzle. As a result, the adhesive 12 is applied to the internal surface of the globe 10, while an excess of the adhesive 12 drops into the groove 112 of the connector 11 and stays there (see the partial expanded sectional view of FIG. 5C). In other words, with the provision of this groove 112, the adhesive 12 is gathered even if it has only low viscosity. Thus, the adhesive 12 can be used not only to form the light diffusion film 100 but also to bond the globe 10 to the connector 11.

Here, if the adhesive 12 overflows from the groove 112 and sticks to the outside surface of the globe 10, the external appearance of the bulb-type fluorescent lamp is spoiled. This can be prevented by setting the smallest height of the inner wall 111 to be smaller than the smallest height of the outer wall 110. In so doing, an excessive accumulation of the adhesive 12 in the groove 112 overflows from the inner wall 111 toward the center of the connector 11, rather than overflowing from the outer wall 110. As a result, the adhesive 12 is kept from sticking to the outside surface of the globe 10. In the connector 11 shown in FIG. 4, for instance, the cuts of the inner wall 111 to form the holding parts 114 may be made deeper than the cuts of the outer wall 110 to form the stoppers 113. In more detail, if the depth of cut for forming the holding parts 114 is about 3–5 mm and the depth of cut for forming the stoppers 113 is about 1–2 mm, the excess adhesive 12 overflows not from the outer wall 110 but from the cuts of the inner wall 111.

Figure 5D:
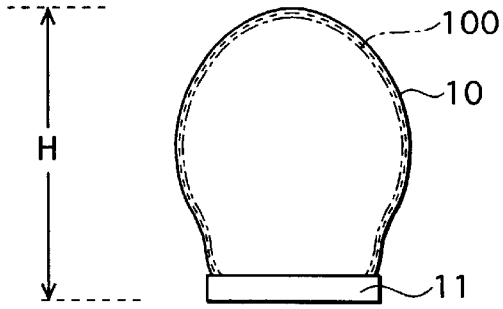

After this, the connector 11 and the globe 10 are placed in a heating furnace while maintaining the distance H, and heated to cure the adhesive 12. As a result, the light diffusion film 100 is formed on the internal surface of the globe 10, and at the same time the globe unit 1 in which the edge part 10*b* of the globe 10 is bonded to the connector 11 is obtained, as shown in FIG. 5D.

After this, the fluorescent tube 31 and the electric ballast 32 are mounted to the holder 30, which is then inserted into the case 20 to engage the projection 201 of the case 20 with the collar 301 of the holder 30, as shown in FIGS. 1–3. Hence the case 20 and the holder 30 are held together.

The connector 11 of the globe unit 1 is then inserted into the groove 310 formed between the case 20 and the holder 30, as shown in FIG. 3. While doing so, the rotation prohibiting parts 115 (FIG. 4) of the connector 11 are caught in the depressions 302 (FIG. 2) of the holder 30, and the stoppers 113 (FIG. 2) of the connector 11 are caught in the depressions 200 of the case 20. Here, means that keeps the connector 11 from being inserted to more than a predetermined depth is provided at the groove 310 between the case 20 and the holder 30. In the example shown in FIG. 3, a slope of the projection 201 in the case 20 serves this purpose. Which is to say, by making the bottom of the connector 11 contact with this slope, the connector 11 is kept from being inserted to more than the predetermined depth.

Lastly, the base 21 is fixed to the case 20, to complete the bulb-type fluorescent lamp.

According to the above manufacturing method, the globe 10 is bonded to the connector 11, and then the connector 11 to which the globe 10 is bonded is fixed into the case 20. This allows the bulb-type fluorescent lamp to be manufactured without having to perform the heating of the hermetically sealed envelope. Accordingly, the tilting of the globe 10 caused by the heating can be avoided. Also, the globe 10 is bonded to the connector 11 while keeping the globe 10 from contact with the bottom of the groove 112 of the connector 11. In so doing, the globe unit 1 can be formed with a uniform height. Which is to say, even if the edge part 10*b* of the globe 10 has surface irregularities, the globe 10 is bonded to the connector 11 without a tilt. Therefore, the globe 10 can be held in a correct position with respect to the case 20. This keeps the external appearance of the bulb-type fluorescent lamp from being ruined, with it being possible to avoid increases of manufacturing costs caused by abandoning defective products.

Moreover, the adhesive 12 that is used to form the light diffusion film 100 on the internal surface of the globe 10 is also used to bond the globe 10 to the connector 11. This not only eliminates the necessity to prepare another adhesive, but also requires only one operation to cure the adhesive 12. Hence increases of manufacturing costs can be avoided when compared with the case where another adhesive is used. Also, the manufacturing operation can be kept from becoming complex. Furthermore, an amount of adhesive necessary for bonding the globe 10 and the connector 11 to each other can be gathered reliably and easily, in the U-shaped groove 112 of the connector 11.

(Modifications to the First Embodiment)

(1) The above embodiment describes the case where the stoppers 113 of the connector 11 are provided on the upper end of the outer wall 110, but the invention is not limited to such. For example, the stoppers 113 may be provided at the bottom of the connector 11.

Figure 6:
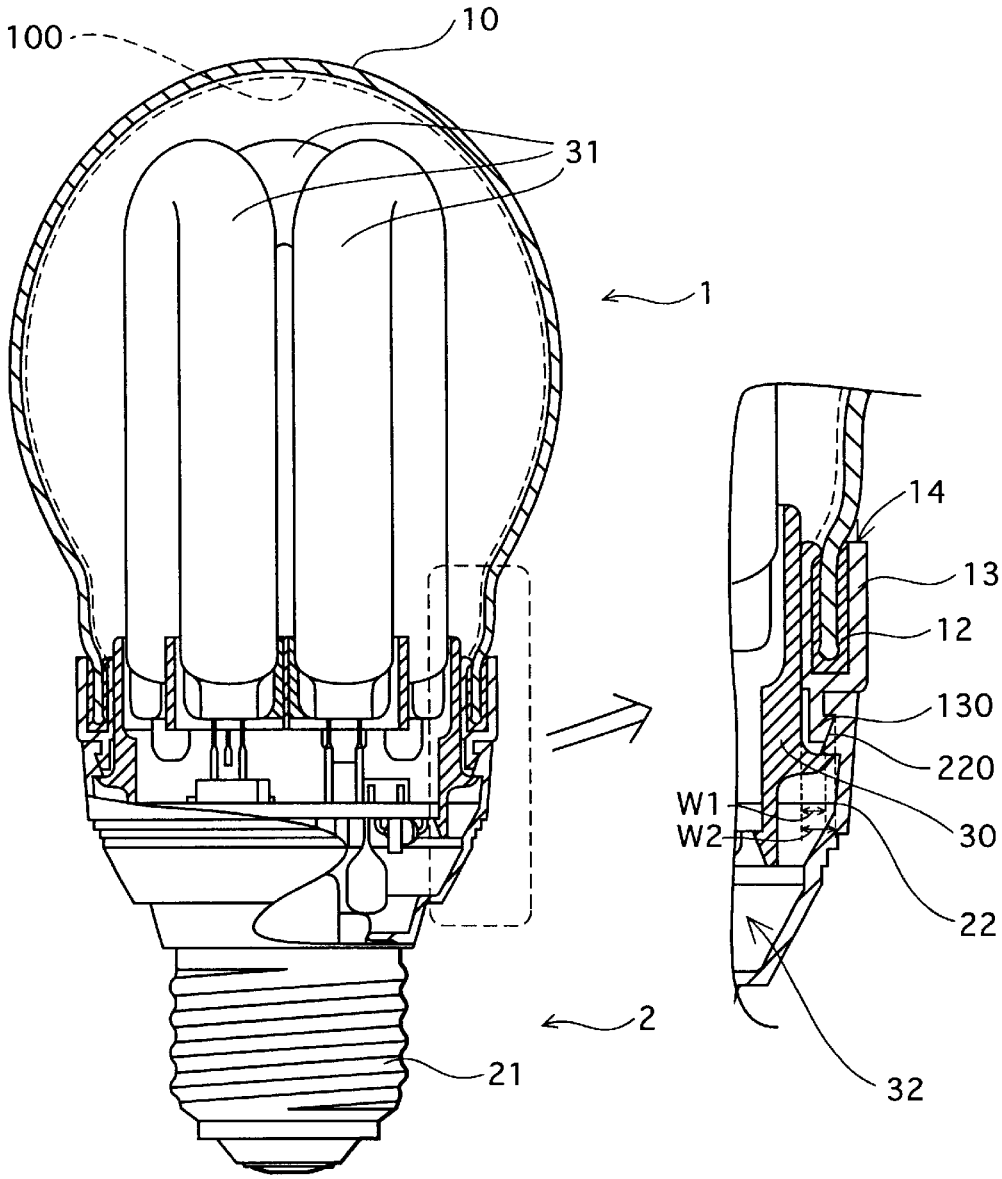
FIG. 6 is a partial broken front view of a bulb-type fluorescent lamp to which a modification to the first embodiment relates.

FIG. 6 is a partial broken front view of a bulb-type fluorescent lamp to which this modification relates. This bulb-type fluorescent lamp has the same construction as that shown in FIG. 1, except for some differences in the shapes of the connector and case. Therefore, construction elements which are the same as those in FIG. 1 are given the same reference numerals and their explanation is omitted.

A connector 13 is formed from a resin such as PBT, polycarbonate (PC), polyethylene terephthalate (PET), or acrylic. The connector 11 is a ring with a U-shaped cross section that has an outer wall and an inner wall which are connected at the bottom. For example, the size of the connector 13 is such that the outer diameter of the outer wall is 47 mm, the inner diameter of the inner wall is 39 mm, and the height of the outer wall is 11 mm (excluding stoppers 130). A groove 14 is provided between the inner wall and the outer wall along the periphery. As one example, the groove 14 has a width of 4 mm, and a depth of 8 mm with respect to the outer wall. The groove 14 is filled with the adhesive 12, which bonds the globe 10 as in the above embodiment. Also, the stoppers 130 with L-shaped cross section are projected downward from the bottom of the connector 13 along the periphery. These stoppers 130 are provided at equal intervals.

Meanwhile, depressions 220 that engage with the stoppers 130 are provided on the internal surface of a case 22. Here, a ring-shaped groove is formed between the external surface of the holder 30 and the internal surface of the case 22. As one example, the groove has a width W1 of 2 mm (a maximum width W2 in the areas where the depressions 220 are present being about 4 mm). The stoppers 130 are inserted into this groove so as to be engaged with the depressions 220. In this way, the connector 13 and the case 22 are held together without using an adhesive. Hence the effects described in the above embodiment can be achieved. Here, the outer wall of the connector 13 is not inserted in the gap between the holder 30 and the case 22 but is exposed to the outside. Also, the case 22 has an external shape similar to the case 20 shown in FIG. 1, except that its total height is a few millimeters shorter than the case 20.

Thus, the same effects as the above embodiment can still be achieved even when the stoppers of the connector are provided at different positions.

(2) The above embodiment describes the case where the connector 11 is engaged with the case 20 to hold the globe unit 1, but the invention is not limited to such. For example, the connector 11 may be engaged with the holder 30 to hold the globe unit 1.

Figure 7:
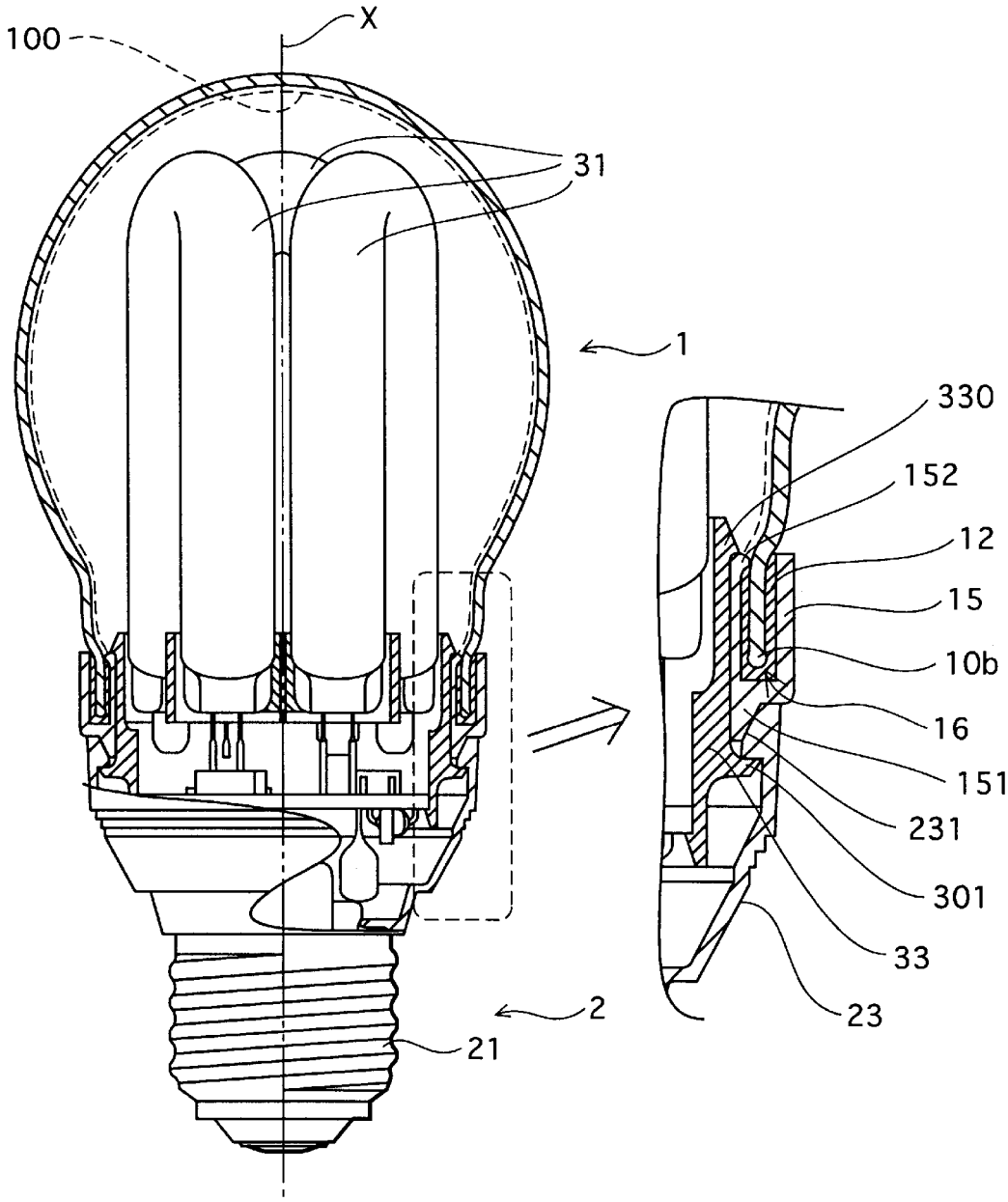
FIG. 7 is a partial broken front view of a bulb-type fluorescent lamp to which another modification to the first embodiment relates.

FIG. 7 is a partial broken front view of a bulb-type fluorescent lamp to which this modification relates. This bulb-type fluorescent lamp has the same construction as that shown in FIG. 1, except for some differences in the shapes of the connector and holder. Accordingly, construction elements which are the same as those shown in FIG. 1 are given the same reference numerals and their explanation is omitted. Note also that a case 23 shown in FIG. 7 has an external shape similar to the case 20 in FIG. 1, except that its total height is a few millimeters shorter than the case 20.

A connector 15 is made of a resin. The connector 15 is a ring with a U-shaped cross section that has an outer wall and an inner wall which are connected at the bottom. For example, the size of the connector 15 is such that the outer diameter of the outer wall is 47 mm, the inner diameter of the inner wall is 39 mm, and the height of the outer wall is 11 mm (excluding projections 151). A groove 16 exists between the outer wall and the inner wall along the periphery. As one example, the groove 16 has a width of 4 mm, and a depth of 8 mm with respect to the outer wall. Also, the projections 151 having tapered slopes are projected downward from the bottom of the connector 15.

Meanwhile, a holder 33 is held in the opening of the case 23 by the same fitting means as in the above embodiment, so as to leave a ring-shaped gap therebetween. Slopes 231 that engage with the tapered slopes of the projections 151 are provided around the internal surface of the case 23. Also, projections 330 are provided around the upper end of the external surface of the holder 33. The connector 15 is caught between the slopes 231 of the case 23 and the projections 330 of the holder 33. As a result, the tapered slopes of the projections 151 are pushed up by the slopes 231 of the case 23 and the top 152 of the inner wall of the connector 15 is engaged with the projections 330 of the holder 33, so that the connector 15 and the holder 33 fit together. Hence the connector 15 is held so as not to move in a direction orthogonal to a central axis X of the lamp (see FIG. 7).

The edge part 10*b* of the globe 10 is inserted in the groove 16 of the connector 15 without contacting the bottom of the groove 16, and is bonded to the connector 15 through the adhesive 12 as in the above embodiment.

Since the holder 33 is fixed to the case 23 through the engagement of the collar 301 as in the above embodiment, the globe 10 and the case 23 are held together without having to use an adhesive. This eliminates the necessity to perform the heating after the formation of the envelope.

Thus, the effects of the above embodiment can still be achieved even if the connector 15 and the holder 33 fit together in this way. Note here that the outer wall of the connector 15 is exposed to the outside in this modification.

(3) Though the connector is engaged with the case or the holder in the above embodiment and modifications, the same effects can still be obtained even when the connector is engaged with a component which integrates the case and the holder.

(4) The above embodiment describes the case where the bulb-type fluorescent lamp has a power rating of 13 W. However, the power rating should not be limited to such, so that the invention can be applied, for example, to a bulb-type fluorescent lamp with a power rating of 22 W.

Second Embodiment

The first embodiment describes the case when the invention is used for a bulb-type fluorescent lamp. On the other hand, the second embodiment describes the case when the invention is used for an electrodeless discharge lamp.

An application of the present invention to an electrodeless discharge lamp is explained below, with reference to drawings.

(Construction of an Electrodeless Discharge Lamp)

Figure 8:
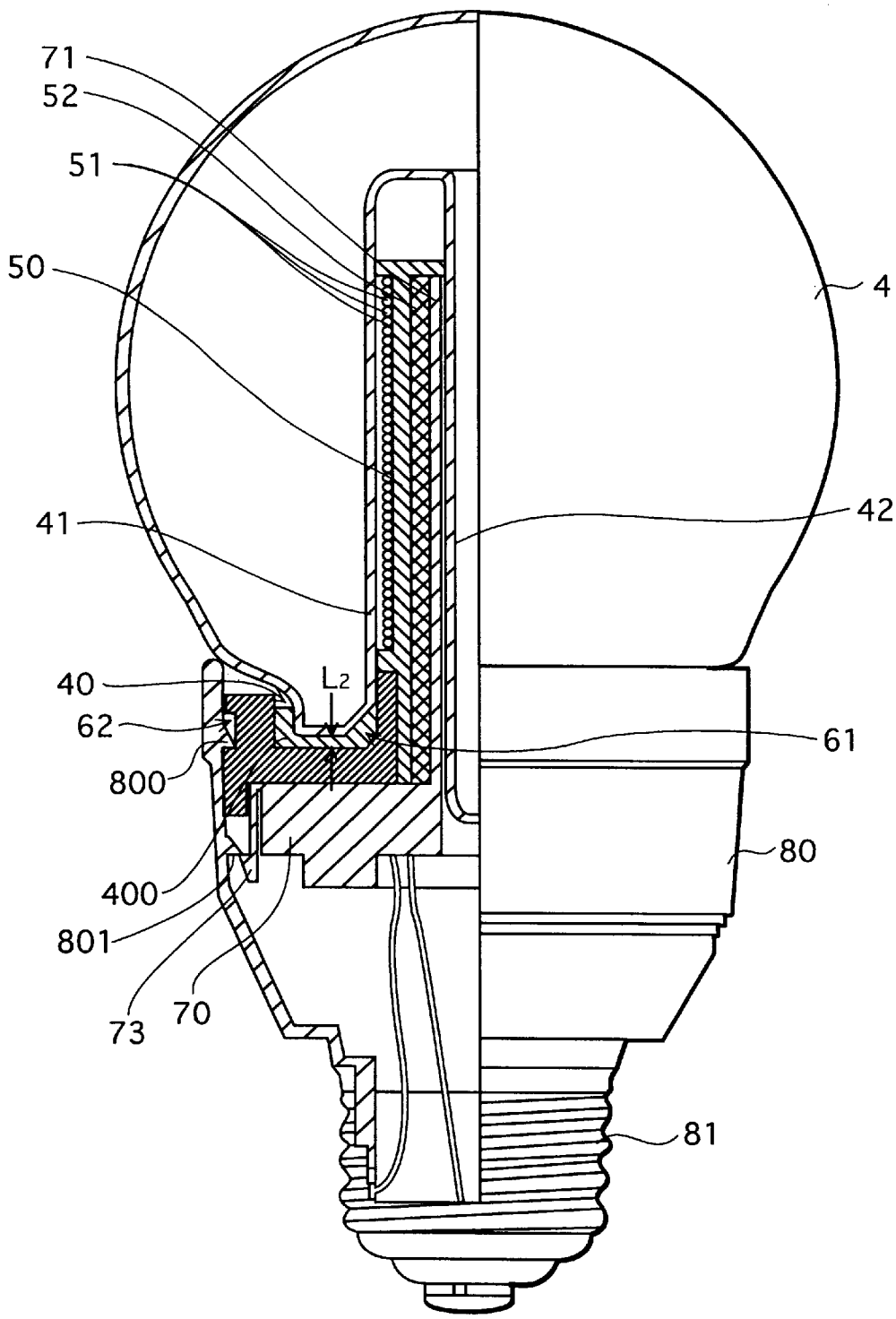
FIG. 8 is a partial broken front view of an electrodeless discharge lamp to which the second embodiment of the invention relates.
Figure 9:
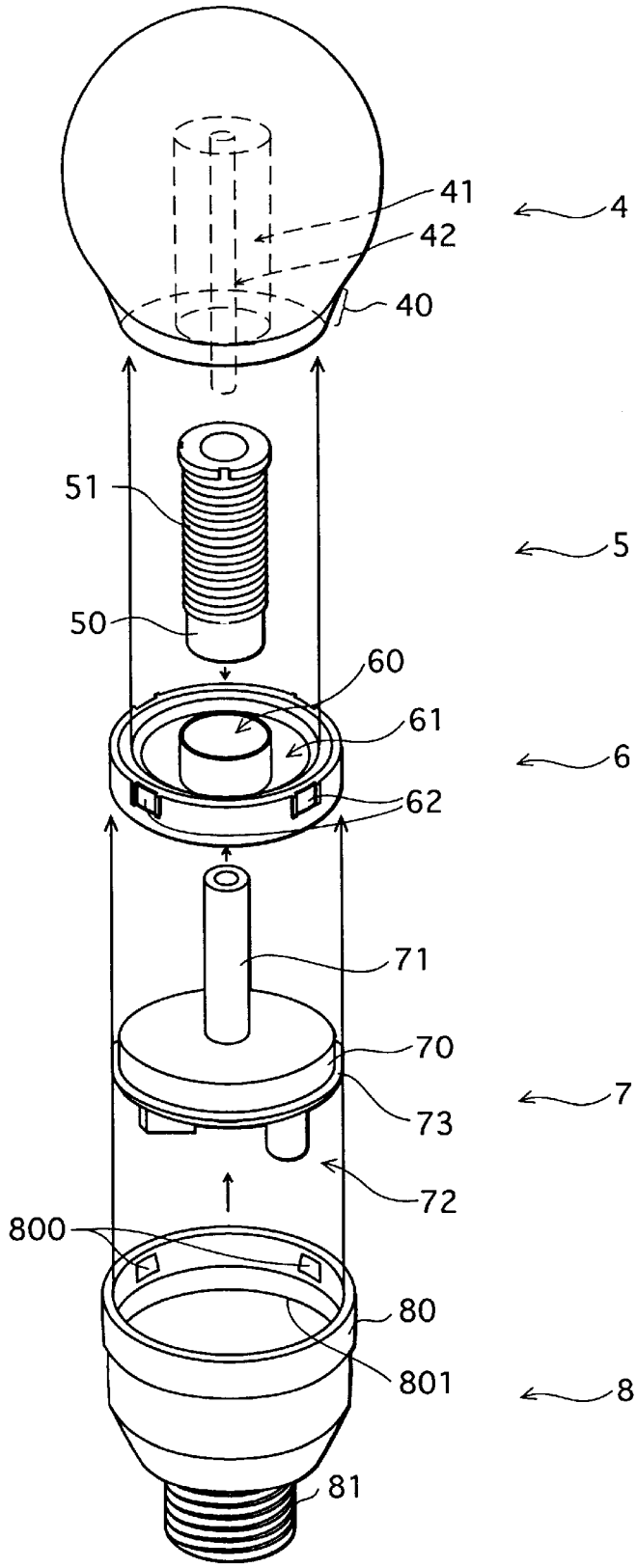
FIG. 9 is a developed view of the electrodeless discharge lamp.
Figure 10:
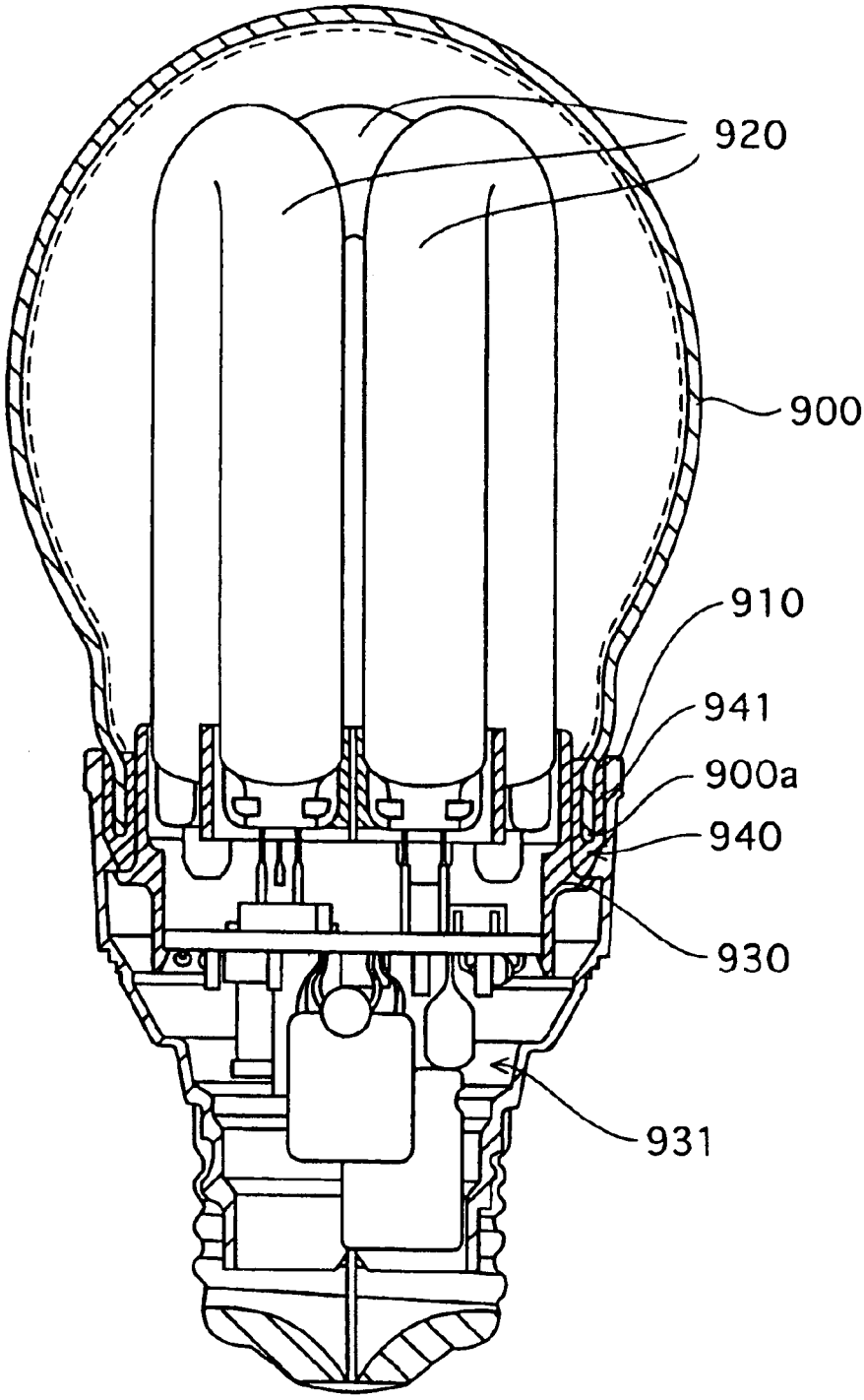
FIG. 10 PRIOR ART
FIG. 10 is a partial broken front view of a conventional bulb-type fluorescent lamp.

FIG. 8 is a partial broken front view of an electrodeless discharge lamp to which the second embodiment of the invention relates. FIG. 9 is a developed perspective view of the electrodeless discharge lamp.

As shown in these drawings, the electrodeless discharge lamp has a globe 4, a coil unit 5, a connector 6, a holder 7, and a case unit 8. The holder 7 is inserted in the case unit 8, and the connector 6 to which the globe 4 and the coil unit 5 are attached is fixed onto the holder 7.

The globe 4 is a hollow spherical member made of glass, and has a constricted neck part 40 at its lower end. A cylindrical depression 41 is formed from the neck part 40 toward the center of the globe 4, and a canalicular part 42 extends along a direction of a central axis of the depression 41. The globe 4 is coated with a phosphor film on its internal surface, and filled with noble gas and a metal vapor of mercury or the like.

The coil unit 5 has a cylindrical coil form 50 and an induction coil 51 which is wound on the coil form 50. A core 52 (FIG. 8) made up of a cylindrical ferrite core, iron core, or the like is inserted in the coil form 50. The coil unit 5 is provided in the depression 41 of the globe 4. When power is applied to the induction coil 51, an electric field occurs in the globe 4, which causes the enclosed metal vapor to collide with electrons. As a result, ultraviolet light is emitted from the metal vapor. This ultraviolet light excites the phosphor film on the internal surface of the globe 4 to emit light. To attach the coil unit 5 to the connector 6, one end of the coil form 50 is fitted into an opening 60 of the connector 6.

The connector 6 is a cylindrical member having the opening 60 at the center, as shown in FIG. 9. Also, a groove 61 with a U-shaped cross section is provided along the periphery of the connector 6. Four depressions 62 are provided at regular intervals on the outer wall of the connector 6. By engaging the depressions 62 with projections 800 of a case 80 in the case unit 8, the connector 6 is fixed to the case 80.

The holder 7 has a stand 70, a core supporter 71, and an electric ballast 72. The cylindrical core supporter 71 for supporting the core 52 is projected from the center of one surface of the stand 70, whereas the electric ballast 72 is provided on the other surface of the stand 70. The electric ballast 72 is equipped with a high-frequency oscillation circuit for converting power applied from the outside into a high-frequency signal which is to be supplied to the induction coil 51, a rectifier, and similar (both the oscillation circuit and the rectifier are not illustrated). Also, a collar 73 is provided on the side wall of the stand 70 along the periphery. By engaging the collar 73 with a projection 801 of the case 80, the holder 7 is fixed to the case 80 and the electric ballast 72 is housed in the case 80. Though the high-frequency oscillation circuit and the like are mounted on the holder 7 in this example, they may be provided outside the electrodeless discharge lamp as a separate unit. In such a case, wiring for supplying the high-frequency signal to the induction coil 51 serves as the electric ballast 72.

The case unit 8 has the case 80 and a base 81. The case 80 is a tapered cylinder. The base 81 is an E-type base which seals one end of the case 80. The other end of the case 80 is opened. The internal surface of the case 80 has the projections 800 and the projection 801. When the holder 7 is inserted through the opening of the case 80 with the electric ballast 72 facing the case 80, the projections 800 and the projection 801 engage with the depressions 62 of the connector 6 and the collar 73 of the stand 70, respectively.

(Construction of the Connector 6)

A construction of the connector 6 which is a characteristic component in this embodiment is explained below.

As shown in FIG. 8, the connector 6 is bonded to the neck part 40 of the globe 4 through an adhesive 400, in the groove 61. Here, the neck part 40 is positioned at a distance L2 from the bottom of the groove 61. In this way, even when the height of the globe 4 varies or the neck part 40 has surface irregularities, the globe 4 can be attached to the case 80 without a tilt, as in the first embodiment. Hence the electrodeless discharge lamp can be manufactured with a uniform height.

Here, the globe 4 and the connector 6 may be bonded to each other using a method similar to that shown in FIG. 5. The only difference lies in that an adhesive needs to be poured into the groove 61 of the connector 6 in the step of FIG. 5C.

The globe 4 which is bonded to the connector 6 in such a way can be fixed to the case unit 8 just by engaging the connector 6 with the case 80. This makes it unnecessary for the globe 4 to be directly bonded to the case unit 8 using an adhesive. Accordingly, the heating to cure an adhesive after the formation of the envelope becomes unnecessary. Thus, the same effects as the first embodiment can be achieved when the present invention is applied to an electrodeless discharge lamp.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A bulb-type lamp comprising:

a globe having a constricted neck part at one end;

a connector having a ring-shaped groove in which the neck part of the globe can be inserted, wherein the globe is bonded to the connector in a state where the neck part is inserted in the groove;

a holder having a stand that supports an electric ballast; and a case having an opening, and holding the holder in a state where the holder is inserted in the case through the opening with the electric ballast being inserted first, wherein in the opening of the case, the connector to which the globe is bonded is fixed to one of the case and the holder by a fitting construction.

2. The bulb-type lamp of claim 1, wherein the globe is bonded to the connector in a state where the neck part which is inserted in the groove is kept from contact with a bottom of the groove.

3. The bulb-type lamp of claim 1, wherein the fitting construction includes a depression and a projection that fit together, the depression and the projection each being provided at a different one out of (a) the connector and (b) one of the case and the holder.

4. The bulb-type lamp of claim 1 being a bulb-type fluorescent lamp in which a fluorescent tube is supported by the stand of the holder, wherein the globe is a hollow spherical member having an open end at which the neck part is formed, a light diffusion film is formed on an internal surface of the globe using an adhesive, and the adhesive used for forming the light diffusion film is also used for bonding the globe to the connector.

5. The bulb-type lamp of claim 4, wherein the connector is a ring having an inner wall and an outer wall which together form a U-shaped cross section, with the ring-shaped groove being present between the inner wall and the outer wall, and the globe is bonded to the connector using part of the adhesive which is gathered in the groove.

6. The bulb-type lamp of claim 5, wherein an arch-shaped leaf spring is formed by cutting part of the inner wall of the connector, and the leaf spring presses the neck part which is inserted in the groove, to temporarily tack the connector to the globe until the adhesive gathered in the groove hardens.

7. The bulb-type lamp of claim 5, wherein the inner wall of the connector has a smaller height than the outer wall of the connector.

8. The bulb-type lamp of claim 4, wherein a depression and a projection that fit together are each provided at a facing portion of a different one of the connector and the holder, so that the connector and the holder move in conjunction with a rotation of the globe which is bonded to the connector.

9. The bulb-type lamp of claim 1 being an electrodeless discharge lamp in which a core supporter is supported by the stand of the holder, and a coil form on which an induction coil is wound is supported by the core supporter.

10. In a light emitting bulb, the improvement comprising:

a globe having a light emitting diffusing coated surface;

a support member for mounting the globe; and an adhesive for bonding the support member to the globe, the adhesive having a light diffusing characteristic wherein the adhesive coats the light emitting surface of the globe for diffusing the light and also provides the bonding of the globe to the support member.

11. The light emitting bulb of claim 10 wherein the support member has a ring configuration with a u-shaped cross section, an inner wall of the support member has a height lower than an outer wall to enable any overflowing adhesive to flow over the inner wall.

12. The light emitting bulb of claim 11 wherein the support member has a plurality of spring projections to hold the globe.

13. A method of assembling a light emitting bulb with a light diffusing globe comprising the steps of:

positioning the globe adjacent a support member;

coating an interior surface of the globe with an adhesive having a light diffusing characteristic; and continuing the coating step after the interior surface of the globe is coated to provide sufficient adhesive between the globe and the adjacent support member to bond the globe to the support member with the adhesive.

14. The method of claim 14 further including drying the adhesive without heating.

15. A bulb-type lamp assembly formed by modular components, comprising:

a globe having a transparent body for transmitting light with an opening having a peripheral connector affixed to and extending about the opening, the opening of a size to receive a light emitting member, the globe connector having an exterior surface with a first fastening unit comprising one of a projecting fastener member and a fastener depression;

a holder supporting a light emitting member; and a case member having an opening for supporting the holder, the case member having an interior surface with a second fastening unit comprising one of a projecting fastener member and a fastener depression of a configuration to cooperatively secure the first fastening unit of the globe connector to the case member by relatively forcing the globe connector exterior surface into the case member interior surface, with the holder captured between the globe connector and the case member, to enable an automatic fastening by engagement of the respective projecting fastener member with the fastener depression whereby the bulb-type lamp is provided with a fitting construction without additional fasteners.

16. The bulb-type lamp assembly of claim 15 wherein the globe connector has an interior surface with radially inward projections and the holder has complementarily depressions to receive the projections and prevent relative rotation.

17. The bulb-type lamp assembly of claim 15 wherein the transparent body of the globe is coated with a light diffusing adhesive mixture that also bonds the peripheral connector to the globe.

* * * * *